US006195915B1

(12) United States Patent
Russell

(10) Patent No.: US 6,195,915 B1
(45) **Date of Patent: *Mar. 6, 2001**

(54) ATHLETIC FOOTWEAR SOLE CONSTRUCTION ENABLING ENHANCED ENERGY STORAGE, RETRIEVAL AND GUIDANCE

(76) Inventor: Brian Russell, 7869 S. Independence Way, Littleton, CO (US) 80123

( * ) Notice: Subject to any disclaimer, the term of this patent is extended or adjusted under 35 U.S.C. 154(b) by 0 days.

This patent is subject to a terminal disclaimer.

(21) Appl. No.: 09/375,110

(22) Filed: Aug. 16, 1999

Related U.S. Application Data

(63) Continuation of application No. 08/903,130, filed on Jul. 30, 1997, now Pat. No. 5,937,544.

(51) Int. Cl.[7] ..... A43B 13/18
(52) U.S. Cl. ..... 36/28; 36/27; 36/29
(58) Field of Search ..... 36/27, 28, 29, 36/3 B, 25 R

(56) References Cited

U.S. PATENT DOCUMENTS

| | | |
|---|---|---|
| Re. 33,066 | 9/1989 | Stubblefield . |
| D. 321,975 | 12/1991 | Amulf et al. . |
| D. 326,956 | 6/1992 | Damianoe et al. . |
| D. 331,832 | 12/1992 | Issler . |
| D. 343,272 | 1/1994 | James . |
| D. 347,105 | 5/1994 | Johnson . |
| 904,891 | 11/1908 | Otlerstedt . |
| 1,382,180 | 6/1921 | Emery . |
| 1,778,089 | 10/1930 | Pomerantz . |
| 1,993,208 | 3/1935 | Cohn . |
| 2,058,975 | 10/1936 | Gray . |
| 2,549,343 | 4/1951 | Stoiner . |
| 2,811,791 | 11/1957 | Cox . |
| 3,086,532 | 4/1963 | Mistarz . |
| 3,100,354 | 8/1963 | Lomard et al. . |
| 3,290,801 | 12/1966 | Bente . |
| 3,402,485 | 9/1968 | McMorrow . |
| 3,834,046 | 9/1974 | Fowler . |
| 4,187,620 | 2/1980 | Selner . |
| 4,259,792 | 4/1981 | Halberstadt . |
| 4,266,349 | 5/1981 | Schmohl . |
| 4,335,530 | 6/1982 | Stubblefield . |
| 4,372,058 | 2/1983 | Stubblefield . |
| 4,798,009 | 1/1989 | Colonel et al. . |
| 4,843,735 | 7/1989 | Nakanishi . |
| 4,888,887 | 12/1989 | Solow . |
| 4,897,937 | 2/1990 | Misevich et al. . |
| 4,922,631 | 5/1990 | Anderie . |

(List continued on next page.)

FOREIGN PATENT DOCUMENTS

| | | |
|---|---|---|
| WO 92/03069 | 3/1992 | (WO) . |
| WO 96/39061 | 8/1996 | (WO) . |

*Primary Examiner*—Ted Kavanaugh
(74) *Attorney, Agent, or Firm*—Knobbe, Martens, Olson & Bear LLP

(57) ABSTRACT

Athletic footwear has an upper and sole. The sole has heel and midfoot regions and metatarsel and toe regions which include a foundation layer of semi-flexible material attached to the upper and defining a plurality of stretch chambers, a stretch layer attached to the foundation layer and having portions of elastic stretchable material underlying the stretch chambers of the foundation layer, and a thrustor layer attached to the stretch layer and having portions of stiff material underlying and aligned with the stretch chambers of the foundation layer. Whereas components of the heel and midfoot regions of the heel provide temporary storage and retrieval of applied energy at central and peripheral sites underlying the heel and midfoot of the wearer's foot, components of the metatarsel and toe regions of the sole provide temporary storage and retrieval of applied energy at independent sites underlying the individual metatarsals and toes of the wearer's foot.

17 Claims, 5 Drawing Sheets

U.S. PATENT DOCUMENTS

| | | |
|---|---|---|
| 4,956,927 | 9/1990 | Misevich et al. . |
| 4,999,931 | 3/1991 | Vermeulen . |
| 5,005,299 | 4/1991 | Whatley . |
| 5,083,910 | 1/1992 | Abshire et al. . |
| 5,311,680 | 5/1994 | Comparetto . |
| 5,319,866 | 6/1994 | Foley et al. . |
| 5,367,791 | 11/1994 | Gross et al. . |
| 5,384,973 | 1/1995 | Lyden . |
| 5,440,826 | 8/1995 | Whatley . |
| 5,465,507 | 11/1995 | Schumacher et al. . |
| 5,595,003 | 1/1997 | Snow . |
| 5,647,145 | 7/1997 | Russell . |
| 5,937,544 * | 8/1999 | Russell . |

* cited by examiner

ATHLETIC FOOTWEAR SOLE CONSTRUCTION ENABLING ENHANCED ENERGY STORAGE, RETRIEVAL AND GUIDANCE

This application is a continuation of U.S. patent application Ser. No. 08/903,130, filed Jul. 30, 1997.

BACKGROUND OF THE INVENTION

1. Field of the Invention

The present invention generally relates to athletic footwear and, more particularly, is concerned with an athletic footwear sole construction having a combination of structural features enabling enhanced storage, retrieval and guidance of wearer muscle energy in a manner that complements and augments performance of participants in recreational and sports activities.

2. Description of the Prior Art

The increasing popularity of athletic endeavors has been accompanied by an increasing number of shoe designs intended to meet the needs of the participants in the various sports. The proliferation of shoe designs has especially occurred for the participants in athletic endeavors involving walking and running. In typical walking and running gaits, it is well understood that one foot is on the ground in a "stance mode" while the other foot is moving through the air in a "swing mode". Furthermore, in the stance mode, the respective foot "on the ground" travels through three successive basic phases; heel strike, mid stance and toe off.

Current shoe designs fail to adequately address the needs of the participant's foot and ankle system during each of these successive stages. Current shoe designs cause the participant's foot and ankle system to lose a significant proportion, by some estimates at least thirty percent, of its functional abilities including its abilities to absorb shock, load musculature and tendon systems, and to propel the runner's body forward. This is because the soles of current walking and running shoe designs fail to address individually the muscles and tendons of a participant's foot. The failure to individually address these foot components inhibits the flexibility of the foot and ankle system, interferes with the timing necessary to optimally load the foot and ankle system, and interrupts the smooth and continuous transfer of energy from the heel to the toes of the foot during the three successive basic phases of the "on the ground" foot travel.

Historically, manufacturers of modern running shoes added foam to cushion a wearer's foot. Then, gradually manufacturers developed other alternatives to foam-based footwear for the reason that foam becomes permanently compressed with repeated use and thus ceases to perform the cushioning function. The largest running shoe manufacturer, Nike Inc. of Beaverton, Oreg., has utilized bags of compressed gas as the means to cushion the wearer's foot. A German manufacturer, Puma AG, has proposed a foamless shoe in which polyurethane elastomer is the cushioning material. Another running shoe manufacturer, Reebok International of Stoughton, Mass., recently introduced a running shoe which has two layers of air cushioning. Running shoe designers heretofore have sought to strike a compromise between providing enough cushioning to protect the wearer's heel but not so much that the wearer's foot will wobble and get out of sync with the working of the knee. The Reebok shoe uses air that moves to various parts of the sole at specific times. For example, when the outside of the runner's heel touches ground, it lands on a cushion of air. As the runner's weight bears down, that air is pushed to the inside of the heel, which keeps the foot from rolling inward too much while another air-filled layer is forcing air toward the forefoot. When the runner's weight is on the forefoot, the air travels back to the heel.

However, no past shoe designs, including the specific ones cited above, are believed to adequately address the aforementioned needs of the participant's foot and ankle system during walking and running activities in a manner that augments performance. The past approaches, being primarily concerned with cushioning the impact of the wearer's foot with the ground surface, fail to even recognize, let alone begin to address, the need to provide features in the shoe sole that will enhance the storage, retrieval and guidance of a wearer's muscle energy in a way that will complement and augment the wearer's performance during the walking, running and jumping activities.

Consequently, a pressing need still remains for improvements in sole construction for athletic footwear that will provide features that will enhance energy utilization.

SUMMARY OF THE INVENTION

The present invention provides an athletic foowear sole construction designed to satisfy the aforementioned needs. The athletic footwear sole of the present invention provides a combination of structural features under the heel, midfoot and forefoot regions of the wearer's foot that enable enhanced storage, retrieval and guidance of muscle energy in a manner that complements and augments wearer performance in sports and recreational activities. The sole construction of the present invention enables athletic footwear for walking, running and jumping to improve and enhance performance by complementing, augmenting and guiding the natural flexing actions of the muscles of the foot. The combination of structural features incorporated in the sole construction of the present invention provides unique control over and guidance of the energy of the wearer's foot as it travels through the three successive basic phases of heel strike, mid stance and toe off.

Accordingly, the present invention is directed to an athletic footwear having an upper and sole with the sole having heel, midfoot, metatarsel, and toe regions wherein the sole comprises a foundation layer of stiff material attached to the upper and defining a plurality of stretch chambers, a stretch layer attached to the foundation layer and having portions of elastic stretchable material underlying the stretch chambers of the foundation layer, and a thrustor layer attached to the stretch layer and having portions of stiff material underlying and aligned with the stretch chambers of the foundation layer and with the portions of the stretch layer disposed between the thrustor layer and foundation layer. Given the above-defined arrangment, interactions occur between the foundation layer, stretch layer and thrustor layer in response to compressive forces applied thereto upon contact of the heel and midfoot regions and metatarsel and toe regions of the sole with a support surface so as to convert and temporarily store energy applied to heel and midfoot regions and metatarsel and toe regions of the sole by a wearer's foot into mechanical stretching of the portions of the stretch layer into the stretch chambers of the foundation layer. The stored applied energy is thereafter retrieved in the form of rebound of the stretched portions of the stretch layer and portions of the thrustor layer therewith. Whereas components of the heel and midfoot regions of the sole provide temporary storage and retrieval of applied energy at central and peripheral sites underlying the heel and midfoot of the wearer's foot, components of the metatarsel and toe regions of the sole provide the temporary storage and retrieval of applied energy at independent sites underlying the individual metatarsals and toes of the wearer's foot.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 2:
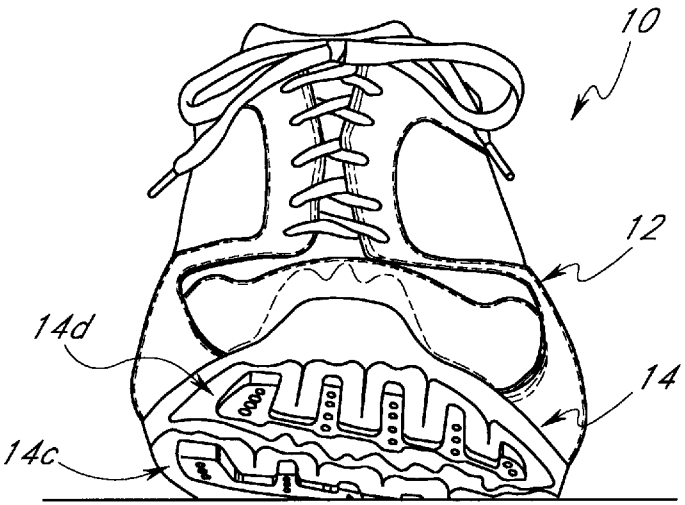
FIG. 2 is a front elevational view of the sole construction.
Figure 1:
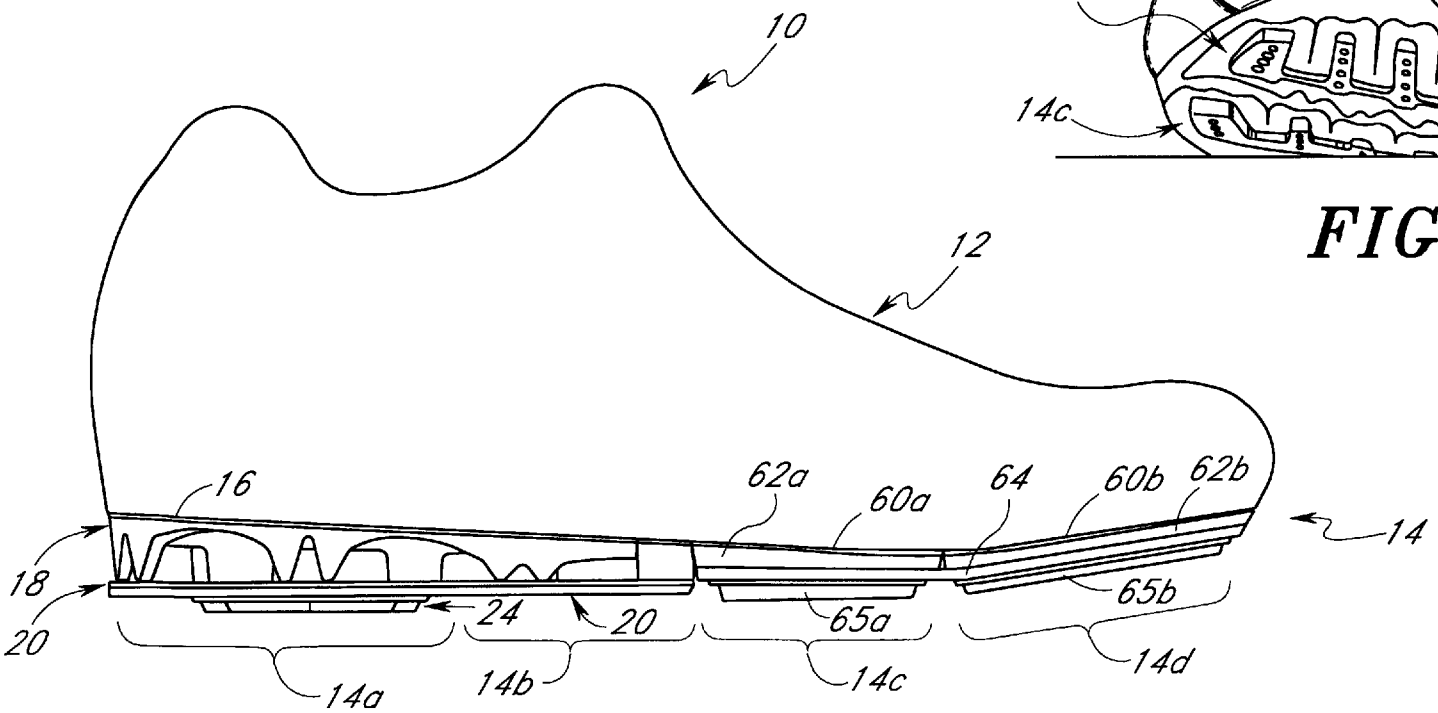
FIG. 1 is a side elevational view of an athletic footwear sole construction of the present invention.

Referring to the drawings and particularly to FIGS. 1 and 2, there is illustrated an article of athletic footwear for walking, running and/or jumping, being generally designated 10. The footwear 10 includes an upper 12 and a sole 14 having heel and midfoot regions 14A, 14B and metatarsel and toe regions 14C, 14D wherein are provided the structural features of the sole 14 constituting the present invention. The sole 14 incorporating the construction of the present invention improves the walking, running and jumping performance of a wearer of the footwear 10 by providing a combination of structural features which complements and augments, rather than resist, the natural flexing actions of the muscles of the foot to more efficiently utilize the muscular energy of the wearer.

Referring to FIGS. 1 and 3 to 8, the heel and midfoot regions 14A, 14B of the sole 14 basically includes the stacked combination of a footbed layer 16, an upper stretch layer 18, an upper thrustor layer 20, a lower stretch layer 22, and a lower thrustor layer 24. The footbed layer 16 of the sole 14 serves as a foundation for the rest of the stacked components of the heel and midfoot regions 14A, 14B. The footbed layer 16 includes a substantially flat foundation plate 26 of semi-rigid semi-flexible thin stiff material, such as fiberglass, whose thickness is chosen to predetermine the degree of flexion (or bending) it can undergo in respose to the load that will be applied thereto.

The foundation plate 26 has a heel portion 26A and a midfoot portion 26B. The foundation plate 26 has a continuous interior lip 26C encompassing a central opening 28 formed in the foundation plate 26 which provides its heel portion 26A with a generally annular shape. The flat foundation plate 26 also has a plurality of continuous interior edges 26D encompassing a corresponding plurality of elongated slots 30 formed in the foundation plate 26 arranged in spaced apart end-to-end fashion so as to provide a U-shaped pattern of the slots 30 starting from adjacent to a forward end 26E of the foundation plate 26 and extending rearwardly therefrom and around the central opening 28. The slots 30 are slightly curved in shape and run along a periphery 26F of the foundation plate 26 but are spaced inwardly from the periphery 26F thereof and outwardly from the central opening 28 thereof so as to leave solid narrow borders respectively adjacent to the periphery 26F and the central opening 28 of the foundation plate 26. The slots 30 alone or in conjunction with recesses 32 of corresponding shape and position in the bottom of the shoe upper 12 define a corresponding plurality of peripheral stretch chambers 34 in the foundation plate 26.

The upper stretch layer 18 is made of a suitable elastic material, such as rubber, and includes a flexible substantially flat stretchable body 36 and a plurality of compressible lugs 38 formed on and projecting downwardly from the bottom surface 36A of the flat stretchable body 36 at the periphery 36B thereof. The peripheral profile of the flat stretchable body 36 of the upper stretch layer 18 generally matches that of the flat foundation plate 26 of the footbed layer 16. In the exemplary embodiment shown in FIGS. 1, 3 and 5 to 8, the compressible lugs 38 are arranged in a plurality of pairs thereof, such as six in number, spaced apart along opposite lateral sides of the flat stretchable body 36. Other arrangements of the compressible lugs 38 are possible so long as it adds stability to the sole 14. For ease of manufacture, the compressible lugs 38 are preferably integrally attached to the flat stretchable body 36.

The upper thrustor layer 20 disposed below and aligned with the upper stretch layer 18 includes a substantially flat support plate 40 preferably made of a a relatively incompressible, semi-rigid semi-flexible thin stiff material, such as fiberglass, having a construction similar to that of the flat foundation plate 26 of the footbed layer 16. The flat support plate 40 has a heel portion 40A and a midfoot portion 40B. The support plate 40 also has a continuous interior rim 40C surrounding a central hole 42 formed through the support plate 40 which provides its heel portion 40A with a generally annular shape. The central hole 42 provides an entrance to a space formed between the flat stretchable body 36 of the upper stretch layer 18 and the flat support plate 40 spaced therebelow which space constitutes a main central stretch chamber 44 of said sole 14. The peripheral profile of the upper thrustor layer 20 generally matches the peripheral profiles of the footbed layer 16 and upper stretch layer 18 so as to provide the sole 14 with a common profile when these components are in an operative stacked relationship with one on top of the other.

The upper thrustor layer 20 also includes a plurality of stretch-generating thrustor lugs 46 made of a relatively incompressible flexible material, such as plastics, and being mounted on the top surface 40D of the flat support plate 40 and projecting upwardly therefrom so as to space the flat support plate 40 below the flat stretchable body 36 of the upper stretch layer 18. The thrustor lugs 46 are arranged in a spaced apart end-to-end fashion which corresponds to that of the slots 30 in the foundation plate 26 so as to provide a U-shaped pattern of the thrustor lugs 46 starting from adjacent to a forward end 40E of the flat support plate 40 and extending rearward therefrom and around the central opening 42. The thrustor lugs 46 run along a periphery 40F of the support plate 40 but are spaced inwardly therefrom and outwardly from the central opening 42 of the support plate 40 so as to leave solid narrow borders respectively adjacent to the periphery 40F and the central opening 42 of the support plate 40. The peripherally-located thrustor lugs 46 thus correspond in shape and position to the peripherally-located slots 30 in the flat foundation plate 26 of the footbed layer 16 defining the peripherally-located stretch chambers 34. For ease of manufacture the thrustor lugs 46 are attached to a common thin sheet which, in turn, is adhered to the top surface 40D of the flat support plate 40.

The flat support plate 40 of the upper thrustor layer 20 supports the thrustor lugs 46 in alignment with the slots 30 and thus with the peripheral stretch chambers 34 of the foundation plate 26 and upper 12 of the shoe 10. However, the flat stretchable body 36 of upper stretch layer 18 is disposed between the stretch-generating thrustor lugs 46 and flat foundation plate 26. Thus, with the footbed layer 16, upper stretch layer 18 and upper thrustor layer 20 disposed in the operative stacked relationship with one on top of the other in the heel and midfoot regions 14A, 14B of the sole 14, spaced portions 36C of the flat stretchible body 36 of the upper stretch layer 18 overlie top ends 46A of the stretch-generating thrustor lugs 46 and underlie the peripheral stretch chambers 34. Upon compression of the footbed layer 16 and upper thrustor layer 20 toward one another from a relaxed condition shown in FIGS. 5 and 6 toward a loaded condition shown in FIGS. 7 and 8, as occurs upon impact of the heel and midfoot regions 14A, 14B of the sole 14 of the shoe 10 with a support surface, the spaced portions 36A of the flat stretchable body 36 are forceably stretched by the upwardly movement of the top ends 46A of the thrustor lugs 46 upwardly past the interior edges 26D of the foundation plate 26 surrounding the slots 30 and into the stretch chambers 34. This can occur due to the fact that the thrustor lugs 46 are enough smaller in their footprint size than that of the slots 30 so as to enable their top ends 46A together with the portions 36A of the flat stretchable body 36 stretched over the top ends 46A of the thrustor lugs 46 to move and penetrate upwardly through the slots 30 and into the peripheral stretch chambers 34, as shown in FIGS. 7 and 8.

The compressible lugs 38 of the upper stretch layer 18 are located in alignment with the solid border extending along the periphery 26F of the foundation plate 26 outside of the thrustor lugs 46. The compressible lugs 38 project downwardly toward the support base 40. The compressive force applied to the foundation plate 26 of the footbed layer 16 and to the support plate 42 of the upper thrustor layer 20, which occurs during normal use of the footwear 10, causes compression of the compressible lugs 38 from their normal tapered shape assumed in the relaxed condition of the sole 14 shown in FIGS. 5 and 6, into the bulged shape taken on in the loaded condition of the sole 14 shown in FIGS. 7 and 8. In addition to adding stability, the function of the compressible lugs 38 is to provide storage of the energy that was required to compress the lugs 38 and thereby to quicken and balance the resistance and rebound qualities of the sole 14.

Figure 3:
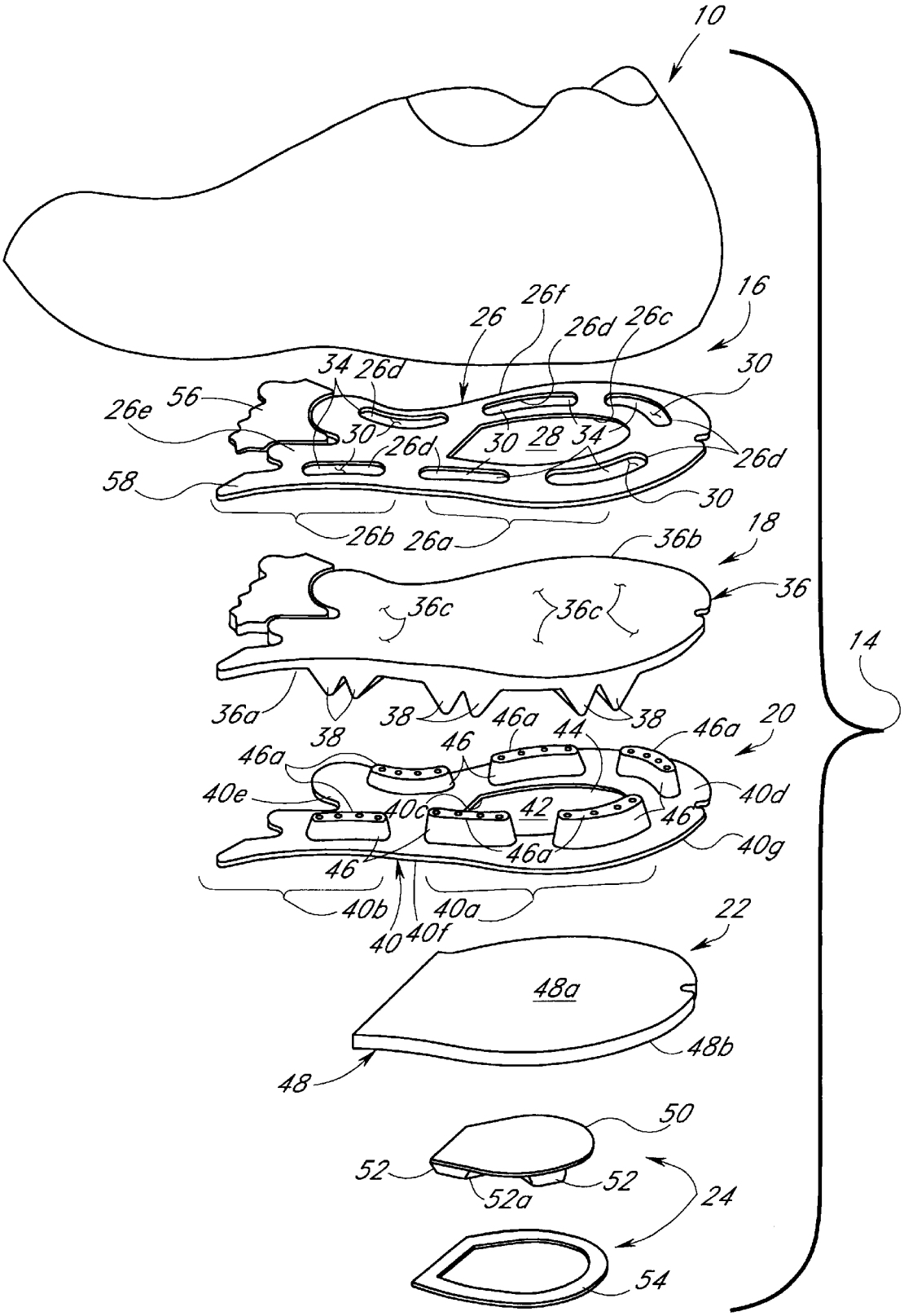
FIG. 3 is an exploded top perspective view of heel and midfoot regions of the sole construction of the present invention.
Figure 4:
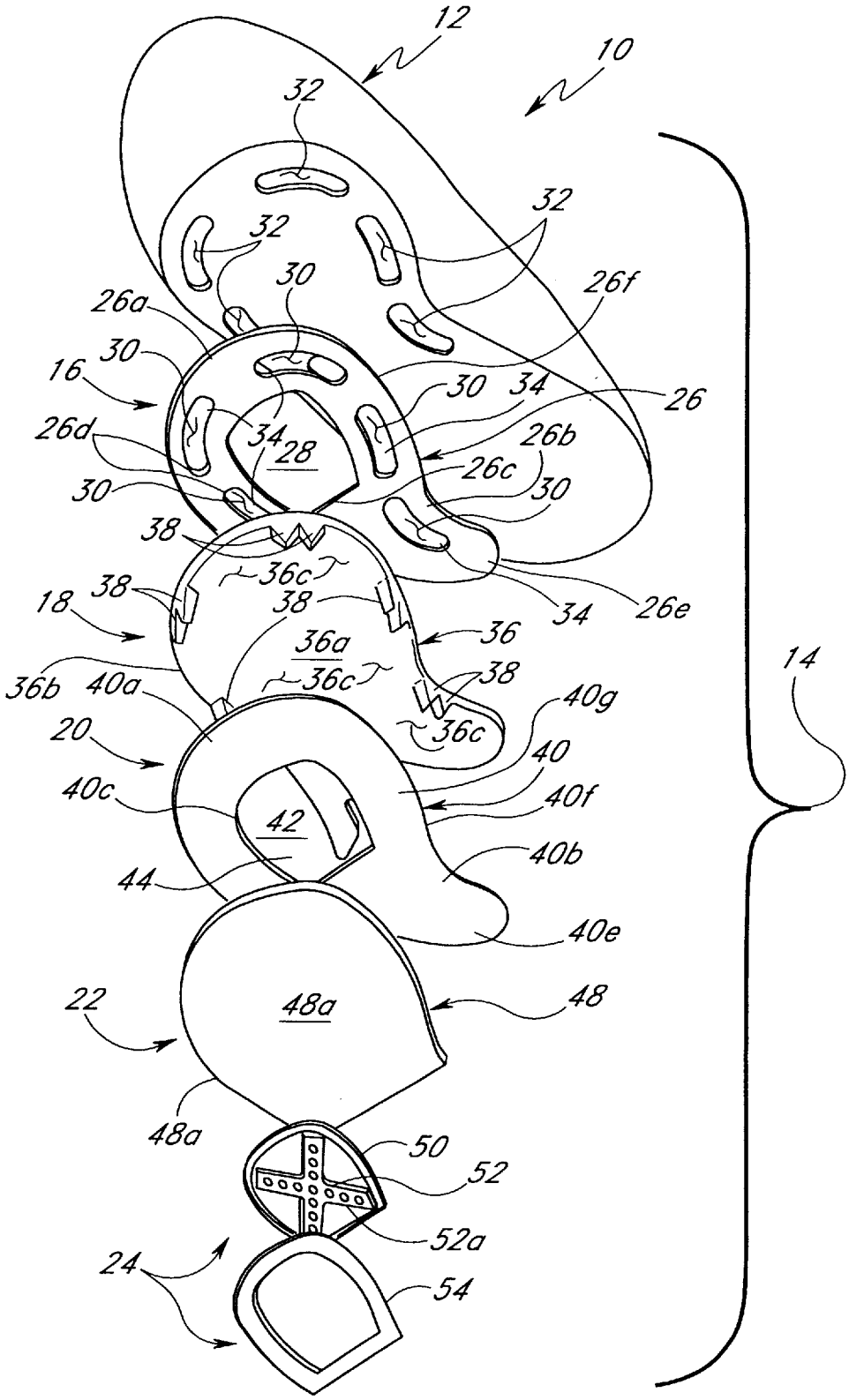
FIG. 4 is an exploded bottom perspective view of heel and midfoot regions of the sole construction.

As can best be seen in FIGS. 1 and 3, the stretch-generating thrustor lugs 46 are generally greater in height at the heel portion 40A of the support plate 40 than at the midfoot portion 40B thereof. This produces a wedge shape through the heel and midfoot regions 14A, 14B of the sole 14 from rear to front, that effectively generates and guides a forward and upward thrust for the user's foot as it moves through heel strike to mid stance phases of the foot's "on the ground" travel.

Figure 8:
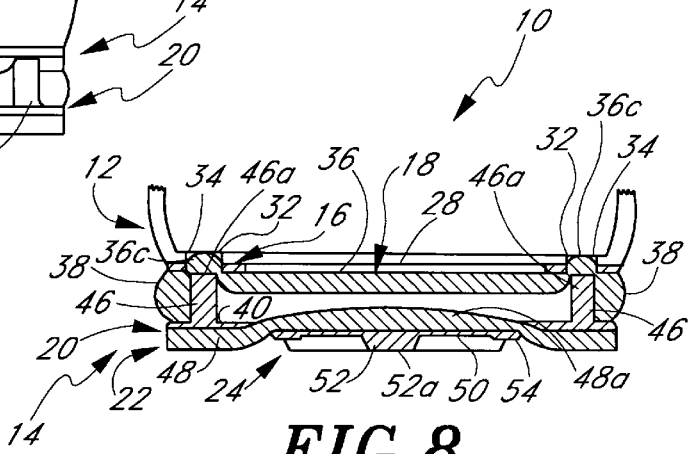
FIG. 8 is a vertical transverse sectional view of the sole construction of FIG. 7.
Figure 9:
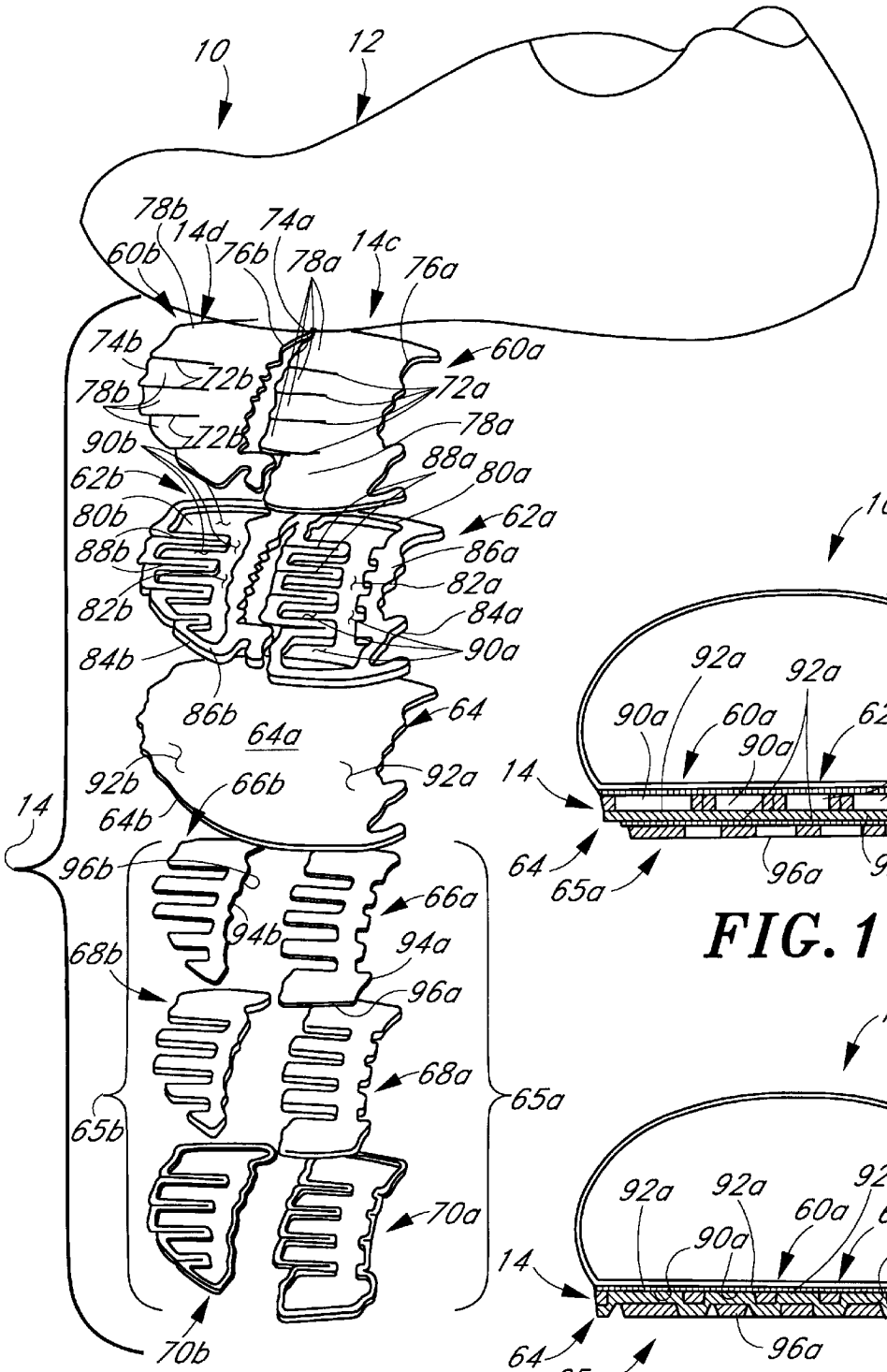
FIG. 9 is an exploded top perspective view of the metatarsel and toe regions of the sole construction of the present invention.
Figure 10:
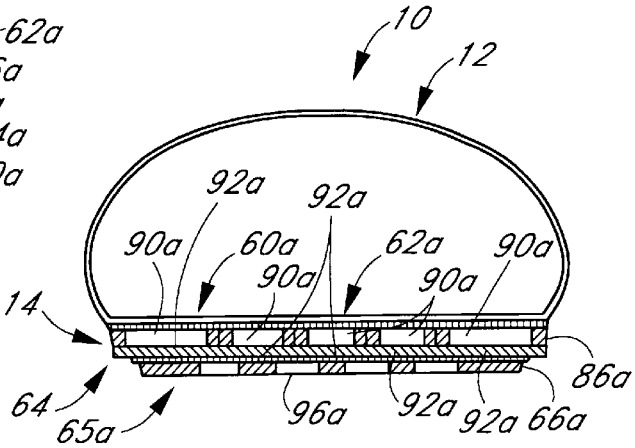
FIG. 10 is a vertical transverse sectional view of the metatarsel region of the sole construction shown in a relaxed condition.
Figure 11:
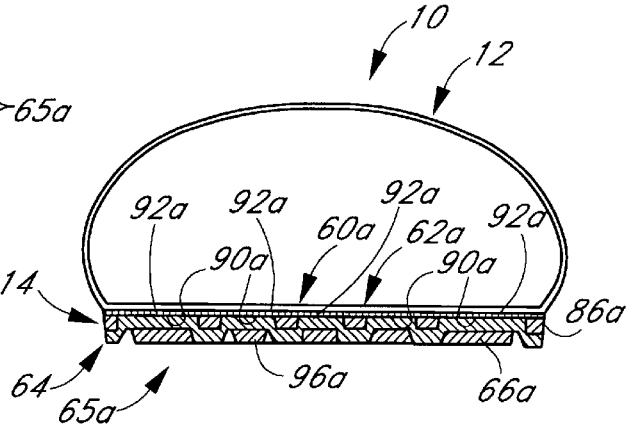
FIG. 11 is a vertical transverse sectional view of the metatarsel region of the sole construction shown in a loaded condition.

Referring to FIGS. 2, 3 and 8, the lower stretch layer 22 is in the form of a flexible thin substantially flat stretchable sheet 48 of resilient elastic material, such as rubber, attached in any suitable manner, such as by gluing, to a bottom surface 40G of the flat support plate 40 of the upper thruster layer 20. The lower thrustor layer 24 disposed below the flat stretchable sheet 48 of the lower stretch layer 22 includes a thrustor plate 50, a thrustor cap 52 and a retainer ring 54. The thrustor plate 50 preferably is made of a suitable semi-rigid semi-flexible thin stiff material, such as fiberglass. The thrustor plate 50 is bonded to the bottom surface of a central portion 48A of the stretchable sheet 48 in alignment with the central hole 42 in the support plate 40 of the upper thrustor layer 20. In operative stacked relationsip of the stretchable sheet 48 of the lower stretch layer 22 between the stretch-generating thrustor plate 50 of the lower thrustor layer 24 and the support plate 40 of the upper thrustor layer 20, the periphery 48B of the central portion 48A of the stretchable sheet 48 overlies the peripheral edge 50A of the stretch-generating thrustor plate 50 and underlie the rim 40C of the support plate 40.

Figure 5:
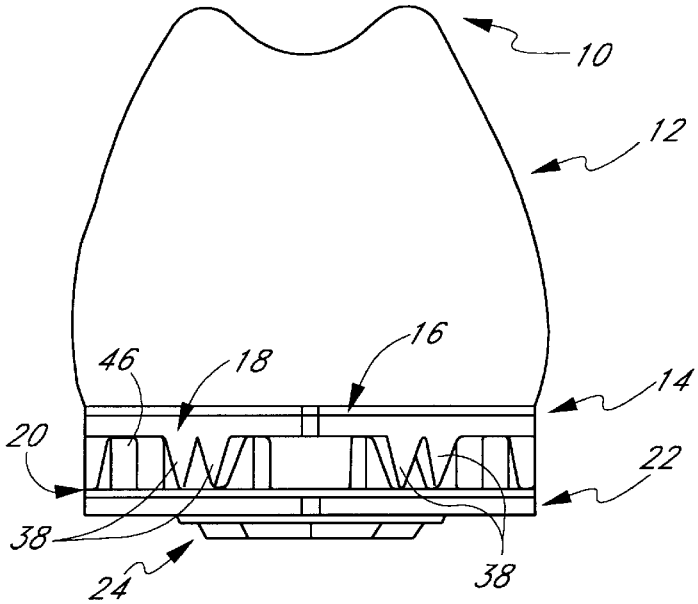
FIG. 5 is a rear end view of the heel region of the sole construction shown in a relaxed condition.
Figure 6:
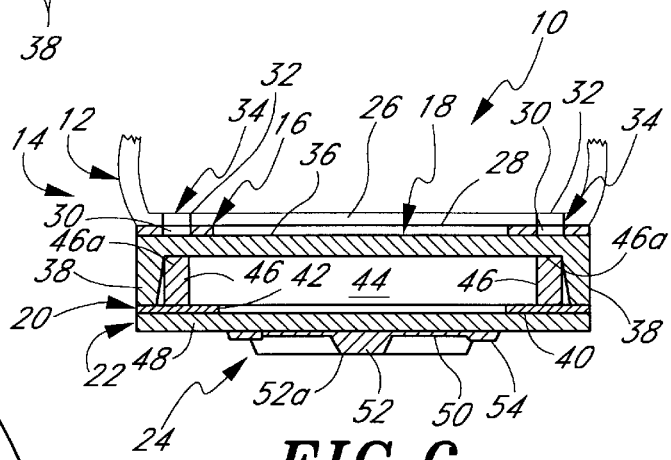
FIG. 6 is a vertical transverse sectional view of the sole construction of FIG. 5.
Figure 7:
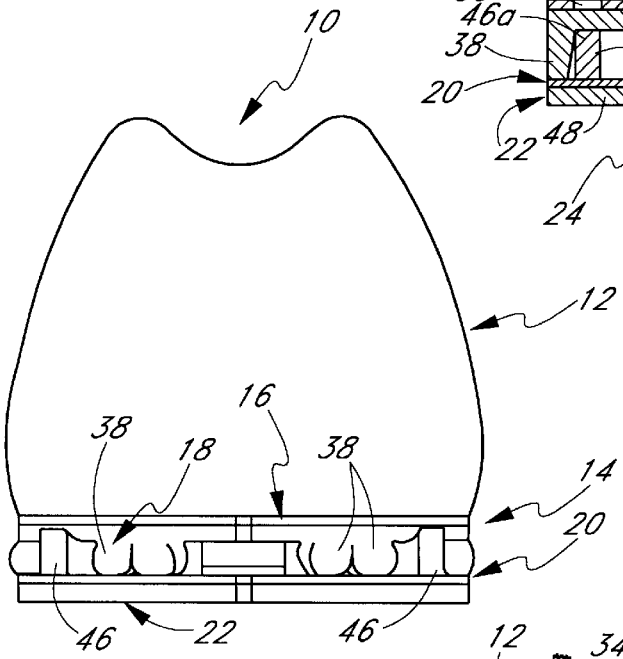
FIG. 7 is a rear end view of the heel region of the sole construction shown in a loaded condition.

Upon compression of the lower thrustor layer 24 toward the upper thrustor layer 20 from a relaxed condition shown in FIGS. 5 and 6 toward a loaded condition shown in FIGS. 7 and 8, as occurs upon impact of the heel and midfoot regions 14A, 14B of the sole 14 of the shoe 10 with a support surface during normal activity, the periphery 48B of the stretchable sheet 48 is forceably stretched by the peripheral edge 50A of the thrustor plate 50 upwardly past the rim 40C surrounding the central hole 42 and into the main central stretch chamber 44. This can occur due to the fact that the thrustor plate 50 is enough smaller in its footprint size than that of the central hole 42 in the support plate 40 so as to enable the thrustor plate 50 together with the periphery 48B of the central portion 48A of the stretchable sheet 48 stretched over the thrustor plate 50 to move and penetrate upwardly through the central hole 42 and into the main centrally-located stretch chamber 44, as shown in FIGS. 7 and 8.

The rigidity of the thrustor plate 50 of the lower thrustor layer 24 encourages a stable uniform movement and penetration of the thrustor plate 50 and resultant stretching of the periphery 48B of the central portion 48A of the stretchable sheet 48 into the main central stretch chamber 44 in response to the application of compressive forces. The thrustor cap 52 is bonded on the bottom surface 50A of the thrustor plate 50 and preferably is made of a flexible plastic or hard rubber and its thickness partially determines the depth of penetration and length of drive or rebound of the thrustor plate 50. The ground engaging surface 52A of the thrustor cap 52 is generally domed shape and presents a smaller footprint than that of the thrustor plate 50. The retainer ring 54 is preferably made of the same material as the thrustor plate 50 and surrounds the thrustor plate 50 and thrustor cap 52. The retainer ring 54 is bonded on the bottom surface of the stretchable sheet 48 in alignment with the central hole 42 in the support plate 40 and surrounds the thrustor plate 50 so as to increase the stretch resistance of the central portion 48A of the stretchable sheet 48 and stabilize the lower thrustor layer 24 in the horizontal plane reducing the potential of jamming or binding of the thrustor plate 50 as it stretches the periphery 48B of the central portion 48A of the stretchable sheet 48 through the central hole 42 in the flat support plate 40 of the upper thrustor layer 20.

The above-described centrally-located interactions in the heel and midfoot regions 14A, 14B of the sole 14 between the support plate 40 of the upper thrustor layer 20, the flat stretchable sheet of the lower stretch layer 22 and flat thrustor plate of the lower thrustor layer 24 of the heel and midfoot regions 14A, 14B occur concurrently and interrelatedly with the peripherally-located interactions between footbed layer 16, the flat stretchable body 36 of the upper stretch layer 18 and the thrustor lugs 46 of the upper thrustor layer 20. These interrelated central and peripheral interactions convert the energy applied to the heel and midfoot regions 14A, 14B of the sole 14 by the wearer's foot into mechanical stretch. The applied energy is thus temporarily stored in the form of concurrent mechanical stretching of the central portion 48A of the lower stretchable sheet 48 of the lower stretch layer 22 and of the spaced portions 36C of the upper stretchable body 36 of the upper stretch layer 18 at the respective sites of the centrally-located and peripherally-located stretch chambers 44, 34. The stored applied energy is thereafter retrieved in the form of concurrent rebound of the stretched portions 36C of the upper stretchable body 36 and the thrustor lugs 46 therewith and of the stretched portion 48A of the lower stretchable sheet 48 and the thrustor plate 40 therewith. The resistance and speed of these stretching and rebound interactions is determined and controlled by the size relationship between the retainer ring 54 and the rim 40C about the central hole 42 of the support plate 49 and between the top ends 46A of the thrustor lugs 46 and the continuous interior edges 26D encompassing the slots 30 of the foundation plate 26. The thickness and elastic qualities preselected for the lower stretchable sheet 48 of the lower stretch layer 22 and the upper stretchable body 36 of the upper stretch layer 18 influence and mediate the resistance and speed of these interactions. The stretching and rebound of the lower stretchable sheet 48 also causes a torquing of the support plate 40. The torquing can be controlled by the thickness of the support plate 40 as well as by the size and thickness of the retainer ring 54.

Referring to FIG. 3, the midfoot region 14B of the sole 14 of the present invention also includes a curved midfoot piece 56 and a compression midfoot piece 58 complementary to the curved midfoot piece 56. The midfoot portion 26B of the foundation plate 26 terminates at the forward end 26E which has a generally V-shaped configuration. The curved midfoot piece 56 preferably is made of graphite and is provided as a component separate from the foundation plate 26. The curved midfoot piece 56 has a configuration which is complementary to and fits with the forward end 26E of the foundation plate 26. The forward end 26E of the foundation plate 26 cradles the number five metatarsal bone of the forefoot as the curved midfoot piece 56 couples the heel and forefoot portions 14A, 14B of the sole 14 so as to load the bones of the forefoot in an independent manner. The peripheral profiles of the upper stretch layer 18 and compression midfoot piece 58 are generally the same as those of the foundation plate 26 and curved midfoot piece 56.

Referring now to FIGS. 1, 2 and 9 to 11, the metatarsel and toe regions 14C, 14D of the sole 14 basically include the stacked combinations of metatarsel and toe articulated plates 60A, 60B, metatarsel and toe foundation plates 62A, 62B, a common metatarsel and toe stretch layer 64, and metatarsel and toe thrustor layers 65A, 65B. The metatarsel and toe thrustor layers 65A, 65B include metatarsel and toe plates 66A, 66B, metatarsel and toe thrustor caps 68A, 68B and metatarsel and toe retainer rings 70A, 70B. Except for a common stretch layer 64 serving both metatarsel and toe regions 14C, 14D of the sole 14, there is one stacked combination of components in the metatarsel region 14C of the sole 14 that underlies the five metatarsals of the wearer's foot and another separate stacked combination of components in the toe region 14D of the sole 14 that underlies the five toes of the wearer's foot. Except for the upper articulated plates 60A, 60B, the above-mentioned stacked combinations of components of the metatarsel and toe regions 14C, 14D of the sole 14 interact (stretching and rebound) generally similarly to the above-described interaction (stretching and rebound) of the stacked combination of components of the heel and midfoot regions 14A, 14B of the sole 14. However, whereas the stacked combination of components of the heel and midfoot regions 14A, 14B provide interrelated main and peripheral sites for temporary storage and retrieval of the applied energy, the stacked combination of components of the metatarsel and toe regions 14C, 14D provide a plurality of relatively independent sites for temporary storage and retrieval of the applied energy at the individual metatarsals and toes of the wearer's foot. The additional components, namely, the articulated plates 60A, 60B, of the metatarsel and toe regions 14C, 14D each has a plurality of laterally spaced slits 72A, 72B formed therein extending from the forward edges 74A, 74B rearwardly to about midway between the forward edges 74A, 74B and rearward edges 76A, 76B of the articulated plates 60A, 60B. These pluralities of spaced slits 72A, 72B define independent deflectable or articulatable appendages 78A, 78B on the metatarsel and toe articulated plates 60A, 60B that correspond to the individual metatarsels and toes of the wearer's foot and overlie and augment the independent characteristic of the respective sites of temporary storage and retrieval of the applied energy at the individual metatarsals and toes of the wearer's foot.

More particularly, the metatarsel and toe articulated plates 60A, 60B are substantially flat and made of a suitable semi-rigid semi-flexible thin stiff material, such as graphite, while the metatarsel and toe foundation plates 62A, 62B disposed below the metatarsel and toe articulated plates 60A, 60B are substantially flat and made of a incompressible flexible material, such as plastic. Each of the metatarsel and toe foundation plates 62A, 62B has a continuous interior edge 80A, 80B defining a plurality of interconnected interior slots 82A, 82B which are matched to the metatarsels and toes of the wearer's foot. The continuous interior edges 80A, 80B are spaced inwardly from located inwardly from the peripheries 84A, 84B of the metatarsel and toe foundation plates 62A, 62B so as to leave continous solid narrow borders 86A, 86B respectively adjacent to the peripheries 84A, 84B. The metatarsel and toe portions of the borders 86A, 86B encompassing or outlining the locations of the separate metatarsels and toes of the wearer's foot and of the appendages 78A, 78B on the articulated plates 60A, 60B are also separated by narrow slits 88A, 88B. The pluralities of interconnected interior slots 82A, 82B define corresponding pluralities of metatarsel and toe stretch chambers 90A, 90B in the respective metatarsel and toe foundation plates 62A, 62B.

The common metatarsel and toe stretch layer 64 is made of a suitable elastic stretchable material, such as rubber, and is disposed below the metatarsel and toe foundation plates 62A, 62B. The peripheral profile of the common stretch layer 64 generally matches the peripheral profiles of the articulated plates 60A, 60B and of the foundation plates 62A, 62B so as to provide the sole 14 with a common profile when these components are in an operative stacked relationship with one on top of the other. The common stretch layer 64 is attached at its upper surface 64A to the respective continuous bordens 86A, 86B of the foundation plates 62A, 62B between their respective continuous interior edges 80A, 80B and peripheries 84A, 84B.

The metatarsel and toe thrustor plates 66A, 66B are disposed below and aligned with the common stretch layer 64 and the pluralities of interconnected interior slots 82A, 82B in foundation plates 62A, 62B forming the metatarsel and toe stretch chambers 90A, 90B. The metatarsel and toe thrustor plates 66A, 66B are made of semi-rigid semi-flexible thin stiff material, such as fiberglass. The metatarsel and toe thrustor plates 66A, 66B are bonded to the lower surface 64B of the common stretch layer 64 in alignment with the pluralities of interconnected interior slots 82A, 82B of forming the metatarsel and toe stretch chambers 90A, 90B of the foundation plates 62A, 62B. In the operative stacked relationsip of the common stretch layer 64 between the stretch-generating metatarsel and toe thrustor plates 66A, 66B and the respective metatarsel and toe foundation plates 62A, 62B, portions 92A, 92B of the common stretch layer 64 overlie the peripheral edges 94A, 94B of the metatarsel and toe thrustor plates 66A, 66B and underlie the continuous interior edges 80A, 80B of the metatarsel and toe foundation plates 62A, 62B.

Upon compression of the lower metatarsel and toe thrustor plates 66A, 66B toward the upper metatarsel and toe foundation plates 62A, 62B from a relaxed condition shown in FIG. 13 toward a loaded condition shown in FIG. 14, as occurs upon impact of the metatarsel and toe regions 14C, 14D of the sole 14 of the shoe 10 with a support surface during normal activity, the portions 92A, 92B of the common stretch layer 64 are forceably stretched by the peripheries 94A, 94B of the metatarsel and toe thrustor plates 66A, 66B upwardly past the continuous interior edges 80A, 80B of the metatarsel and toe foundation plates 62A, 62B into the metatarsel and toe stretch chambers 90A, 90B. This can occur due to the fact that the metatarsel and toe thrustor plates 66A, 66B are enough smaller in their respective footprint sizes than the sizes of the slots 82A, 82B in the metatarsel and toe foundation plates 62A, 62B so as to enable the metatarsel and toe thrustor plates 66A, 66B together with the portions 92A, 92B of the common stretch layer 64 stretched over the respective thrustor plates 66A, 66B to move and penetrate upwardly through the slots 82A, 82B and into the metatarsel and toe stretch chambers 90A, 90B, as shown in FIG. 14.

The rigidity of the metatarsel and toe thrustor plates 66A, 66B encourages a stable uniform movement and penetration of the thrustor plates 66A, 66B and resultant stretching of the portions 92A, 92B of the common stretch layer 64 into the metatarsel and toe stretch chambers 90A, 90B in response to the application of compressive forces. The metatarsel and toe thrustor caps 68A, 68B are bonded respectively on the bottom surfaces 96A, 96B of the metatarsel and toe thrustor plates 66A, 66B and preferably is made of a flexible plastic or hard rubber and their respective thicknesses partially determine the depth of penetration and length of drive or rebound of the metatarsel and toe thrustor plates 66A, 66B. The metatarsel and toe retainer rings 70A, 70B are preferably made of the same material as the metatarsel and toe thrustor plates 66A, 66B and surround the respective thrustor plates 66A, 66B and thrustor caps 68A, 68B. The metatarsel and toe retainer rings 70A, 70B are bonded on the lower surface 64B of the common stretch layer 64 in alignment with the interior slots 82A, 82B and surround the thrustor plates 66A, 66B so as to increase the stretch resistance of the portion 92A, 9213 of the common stretch layer 64 and stabilize the metatarsel and toe thrustor plates 66A, 66B in the horizontal plane reducing the potential of jamming or binding of the thrustor plates 66A, 66B as they stretch the peripheries of the portions 92*a*, 92B of the common stretch layer 64 into the metatarsel and toe stretch chambers 90A, 90*b* in the metatarsel and toe foundation plates 62A, 62B.

The above-described plurality of stretching interactions between the metatarsel and toe foundation plates 62A, 62B, common stretch layer 64 and metatarsel and toe thrustor plates 66A, 66B of the metatarsel and toe regions 14C, 14D in their stacked relationship converts the energy applied to the metatarsels and toes by the wearer's foot into mechanical stretch. The applied energy is stored in the form of mechanical stretching of the metatarsel and toe portions 92A, 92B of the common stretch layer 64 at the respective sites of the metatarsel and toe stretch chambers 90A, 90B. The applied energy is retrieved in the form of rebound of the stretched portions 92A, 92B of the common stretch layer 64 and the thrustor plates 66A, 66b therewith. The resistance and speed of these stretching interactions is determined and controlled by the size relationship between the retainer rings 70A, 70B and the continuous interior edges 80A, 80B in the metatarsel and toe foundation plates 62A, 62B. The thickness and elastic qualities preselected for the common stretch layer 64 influence and mediate the resistance and speed of these interactions. The peripheral profiles of the metatarsel and toe thrustor plates 66A, 66B are generally the same. The previously described midfoot pieces 56, 58 also provide a bridge between the components of the heel and midfoot regions 14A, 14B of the sole 14 and the components of the metatarsel and toe regions 14C, 14D of the sole 14.

Preliminary experimental treadmill comparative testing of a skilled runner wearing prototype footwear 10 having soles 14 constructed in accordance with the present invention with the same runner wearing premium quality conventional footwear, has demonstrated a significantly improved performance of the runner while wearing the prototype footwear in terms of the runner's oxygen intake requirements. The prototype footwear 10 compared to the conventional footwear allowed the runner to use from ten to twenty percent less oxygen running at the same treadmill speed. The dramatically reduced oxygen intake requirement can only be attributed to an equally dramatic improvement of the energy efficiency that the runner experienced while wearing the footwear 10 having the heel construction of the present invention. It is reasonable to expect that this dramatic improvement in energy efficiency will translate into dramatic improvement in runner performance as should be reflected in elapsed times recorded in running competitions.

It is thought that the present invention and its advantages will be understood from the foregoing description and it will be apparent that various changes may be made thereto without departing from the spirit and scope of the invention or sacrificing all of its material advantages, the form hereinbefore described being.merely preferred or exemplary embodiment thereof.

I claim:

1. A sole construction, comprising:

a stretch layer having a first side and a second side;

a foundation layer disposed on said first side of said stretch layer defining a plurality of stretch chambers peripherally-located so as to underlie at least a heel portion of a wearer's foot, wherein said stretch layer has at least portions of elastic stretchable material aligned with said stretch chambers of said foundation layer; and a thrustor layer including a plurality of thrustors thereon disposed on said second side of said stretch layer, said plurality of thrustors being disposed only along a periphery of said thrustor layer and aligned with said stretch chambers of said foundation layer and with said portions of elastic stretchable material of said stretch layer disposed between said plurality of thrustors and said foundation layer such that interactions can occur between said foundation layer, stretch layer and plurality of thrusters in response to compressive forces applied thereto upon contact of said sole construction with a support surface so as to convert and temporarily store energy applied to said sole construction by a wearer's foot into mechanical stretching of said portions of said stretch layer into said stretch chambers, said stored applied energy thereafter being retrieved in the form of rebound of said stretched portions of elastic stretchable material of said stretch layer and said plurality of thrustors therewith.

2. The sole construction of claim 1, wherein said plurality of thrusters surround a central hole in said thrustor layer.

3. The sole construction of claim 1, wherein said peripherally-located stretch chambers are defined by a plurality of elongated slots formed in a spaced apart end-to-end generally U-shaped arrangement in said foundation layer.

4. The sole construction of claim 3, wherein said plurality of thrustors are elongated in shape and positioned in a spaced apart end-to-end generally U-shaped arrangement to align with said stretch chambers.

5. The sole construction of claim 1, wherein said plurality of thrustors are generally greater in height at a rear portion of the sole construction than at a front portion of the sole construction.

6. The sole construction of claim 1, further comprising a plurality of compressible lugs on said second side of said stretch layer.

7. The sole construction of claim 1, wherein said first side of said stretch layer is an upper side and said second side of stretch layer is a lower side.

8. A sole construction, comprising:

a first stretch layer having a first side and a second side;

a foundation layer disposed on said first side of said first stretch layer and defining at least one stretch chamber, wherein said first stretch layer has at least one portion made of elastic stretchable material aligned with said at least one stretch chamber of said foundation layer;

a first thrustor layer disposed on said second side of said first stretch layer and defining at least one stretch chamber and having at least one thrustor made of stiff material aligned with said at least one stretch chamber of said foundation layer and with said at least one portion of elastic stretchable material of said first stretch layer disposed between said first thrustor layer and said foundation layer;

a second stretch layer having a first side and a second side disposed such that said first thrustor layer is disposed on said first side of said second stretch layer and lies between said first stretch layer and said second stretch layer; and a second thrustor layer comprising at least one thrustor disposed on said second side of said second stretch layer and aligned with said at least one stretch chamber of said first thrustor layer;

wherein a compressive force applied to said sole construction causes said at least one thrustor of said first thrustor layer and said at least one thrustor of said second thrustor layer to move against said first and second thrustor layers, respectively, into said respective at least one stretch chambers.

9. The sole construction of claim 8, wherein said foundation layer is disposed on an upper side of said first stretch layer.

10. The sole construction of claim 8, wherein said foundation layer defines a plurality of stretch chambers generally underlying a heel portion of a wearer's foot.

11. A sole construction, comprising:

a first stretch layer having a first side and a second side;

a foundation layer disposed on said first side of said first stretch layer and defining at least one stretch chamber, wherein said first stretch layer has at least one portion made of elastic stretchable material aligned with said at least one stretch chamber of said foundation layer;

a first thrustor layer disposed on said second side of said first stretch layer and having at least one thrustor made of stiff material aligned with said at least one stretch chamber of said foundation layer and with said at least one portion of elastic stretchable material of said first stretch layer disposed between said first thrustor layer and said foundation layer;

a second stretch layer having a first side and a second side disposed such that said first thrustor layer lies between said first stretch layer and said second stretch layer; and a second thrustor layer comprising at least one thrustor disposed on said second side of said second stretch layer and aligned with at least one stretch chamber;

wherein said at least one stretch chamber aligned with said at least one thrustor of said second thrustor layer is defined by a hole in said first thrustor layer.

12. The sole construction of claim 11, wherein said hole in said first thrustor layer is centrally-located to generally underlie a heel portion of a wearer's foot.

13. A sole construction, comprising:

a footbed layer defining a plurality of peripherally-located stretch chambers generally underlying at least a heel portion of a wearer's foot;

an upper stretch layer disposed below said footbed layer and having portions made of elastic stretchable material underlying said peripherally-located stretch chambers of said footbed layer;

an upper thrustor layer disposed below said upper stretch layer and having peripheral portions made of stiff material underlying and aligned with said peripherally-located stretch chambers of said footbed layer and with said portions of elastic stretchable material of said upper stretch layer disposed between said upper thrustor layer and said footbed layer, said upper thrustor layer also having a central hole formed therein defining a centrally-located stretch chamber generally underlying said heel portion of said wearer's foot;

a lower stretch layer disposed below said upper thrustor layer and having a central portion made of elastic stretchable material and underlying said centrally-located stretch chamber of said upper thrustor layer; and a lower thrustor made of stiff material underlying and aligned with said centrally-located stretch chamber of said upper thrustor layer and with said central portion of said lower stretch layer disposed between said lower thrustor and said upper thrustor layer such that interaction between said upper thrustor layer, lower stretch layer and lower thrustor occur concurrently with interactions between said footbed layer, upper stretch layer and upper thrustor layer in response to compressive forces applied thereto upon contact of said sole construction with a support surface so as to convert and store energy applied to said sole construction by a wearer's foot into concurrent mechanical stretching of said central portion of said lower stretch layer and of said spaced portions of said upper stretch layer respectively in said centrally-located and peripherally-located stretch chambers, said stored applied energy is thereafter retrieved in the form of concurrent rebound of said stretched central portion of said lower stretch layer and said lower thrustor and of said stretched peripheral portions of said upper stretch layer and said peripheral portions of said upper thrustor layer therewith.

14. A sole construction, comprising:

a thrustor layer having a plurality of peripherally-located thrusters generally underlying the periphery of a heel portion of a wearer's foot;

a central thrustor generally underlying a heel portion of a wearer's foot;

a plurality of stretch chambers aligned with said plurality of peripherally-located thrusters;

a central stretch chamber aligned with said central thrustor;

a first portion of elastic stretchable material disposed between said plurality of peripherally-located thrustors and said plurality of stretch chambers; and a second portion of elastic stretchable material disposed between said central thrustor and said central stretch chamber.

15. The sole construction of claim 14, wherein said central thrustor is sized to have a larger footprint than each of said plurality of peripherally-located thrusters.

16. The sole construction of claim 14, wherein said central stretch chamber is at least defined by a hole in said thrustor layer.

17. The sole construction of claim 14, further comprising a foundation layer, wherein said plurality of stretch chambers are defined by holes in said foundation layer.

* * * * *

UNITED STATES PATENT AND TRADEMARK OFFICE

CERTIFICATE OF CORRECTION

PATENT NO. : 6,195,915 B1
DATED : March 6, 2001
INVENTOR(S) : Brian Russell

It is certified that error appears in the above-identified patent and that said Letters Patent is hereby corrected as shown below:

Column 11,
Line 13, “thrusters” should be -- thrustors --.
Line 24, “thrusters” should be -- thrustors --.

Column 14,
Line 2, “thrusters” should be -- thrustors --.
Line 7, “thrusters” should be -- thrustors --.
Line 15, “thrusters” should be -- thrustors --.

Signed and Sealed this

Nineteenth Day of November, 2002

*Attest:*

*Attesting Officer*

JAMES E. ROGAN
*Director of the United States Patent and Trademark Office*